United States Patent [19]

Johnson et al.

[11] 4,189,891

[45] Feb. 26, 1980

[54] METHOD FOR ANCHORING AND STRAIGHTENING WALLS

[75] Inventors: Michael K. Johnson, Des Moines; Clarence E. Johnson, Winterset; Raymond E. Parker, Winterset; John V. Wright, Winterset, all of Iowa

[73] Assignee: Grip Tite Mfg. Co., Winterset, Iowa

[21] Appl. No.: 895,944

[22] Filed: Apr. 13, 1978

[51] Int. Cl.[2] ..... E02D 27/00

[52] U.S. Cl. ..... 52/742; 52/169.6; 52/514; 405/262; 405/284

[58] Field of Search ..... 52/741, 742, 514, 169.1, 52/169.8, 169.6, 166; 405/259, 262, 284

[56] References Cited

U.S. PATENT DOCUMENTS

| | | | |
|---|---|---|---|
| 377,940 | 2/1888 | Hevner | 52/514 |
| 2,068,831 | 1/1937 | Washburn | 52/169.1 |
| 3,507,121 | 4/1970 | Morfeldt | 52/742 |
| 3,798,857 | 3/1974 | Barrera | 52/169.8 |
| 4,074,481 | 2/1978 | Lang | 52/169.8 |

FOREIGN PATENT DOCUMENTS

| | | | |
|---|---|---|---|
| 2062612 | 6/1972 | Fed. Rep. of Germany | 52/169.1 |

*Primary Examiner*—James A. Leppink
*Assistant Examiner*—Henry E. Raduazo
*Attorney, Agent, or Firm*—Henderson & Sturm

[57] ABSTRACT

A method for anchoring and straightening a wall which extends below the ground including the steps of forming a hole in the ground at a distance from the wall, forming an opening in the wall from one side of the wall at a level below the ground, driving a shaft through the opening in the wall until one end thereof extends into the hole in the ground, securing an anchoring device to the end of the member in the hole, attaching a wall plate to the other end of the shaft by threading a nut onto the other end of the shaft and tightening the nut so that the wall plate is forced against the wall to thereby straighten and anchor the wall.

5 Claims, 6 Drawing Figures

METHOD FOR ANCHORING AND STRAIGHTENING WALLS

BACKGROUND OF THE INVENTION

The present invention relates generally to a method for straightening a basement wall which has been pushed in by hydrostatic pressure, and more particularly to such a straightening method which utilizes an anchoring device.

A very common problem with many basement walls is that water tends to build up on the outside of such basement walls which causes a very high hydrostatic pressure against these walls. If this pressure becomes great enough, it will cause the wall to be pushed into the basement to some extent. Commonly, a large crack will appear in the wall. Besides the obvious problem of the unsightly nature of such crack, such a crack will allow water into the basement and if the hydrostatic pressure continues to increase, the wall could eventually be pushed in sufficiently that it would collapse, thereby removing the support provided for the building above it.

The usual method of solving the problem referred to above is to place temporary support posts under the house adjacent to the wall and then to knock the wall in or out. This normally requires that a great deal of dirt be dug out beside the house and piled up near the house until such time that the debris from the old wall can be removed and a new basement wall constructed. At that time then the fill dirt would be put back in place adjacent to such basement wall so that the ground is substantially at the same level as before the excavation began. This is of course a very expensive and time consuming operation. Additionally, such procedure quite often requires that shrubbery planted next to the wall be removed and wherein such shrubbery is normally necessarily damaged or destroyed in the process. Many people also object strenuously to having large piles of dirt present surrounding their residence, which is necessary while the old wall is being removed and the new one constructed.

Another approach to the problem of straightening walls is disclosed in U.S. Pat. No. 3,537,220, but such a method requires the use of specially constructed apparatus which might be different from one wall straightening job to the next.

Consequently, there is a genuine need for a more economical way to anchor and straighten basement walls.

SUMMARY OF THE INVENTION

The present invention relates to a method for anchoring and straightening a wall which extends below the ground including the steps of forming a hole in the ground at a distance from the wall, forming an opening in the wall from one side of the wall at a level below the ground, placing an elongated member through the opening in the wall and through the ground so that one end of the member extends into the hole in the ground and the other end of the member extends on the one side of the wall, securing an anchoring structure to one end of the member, attaching a wall plate to the other end of the elongated member and then forcing the wall plate against the wall by use of the attaching mechanism for thereby straightening the wall.

An object of the present invention is to provide an improved method for anchoring and straightening basement walls.

Another object of the invention is to provide a method for anchoring and straightening walls which is extremely economical.

A further object of the invention is to provide a method for anchoring and straightening walls which alleviates the need to destroy shrubbery planted adjacent to the wall to be straightened.

Still another object of the invention is to provide an anchoring and straightening method which allows the wall to be straightened somewhat each time the ground dries and shrinks away from the wall.

A still further object of the invention is to alleviate the need to have large piles of excavated dirt outside of a home or residence for extended periods of time.

A still further object of the invention is to provide a method for anchoring and straightening basement walls which is effective but yet fast and simple to perform.

Other objects, advantages and novel features of the present invention will become apparent from the following detailed description of the invention when considered in conjunction with the accompanying drawings.

DESCRIPTION OF THE PREFERRED EMBODIMENT

Figure 1:
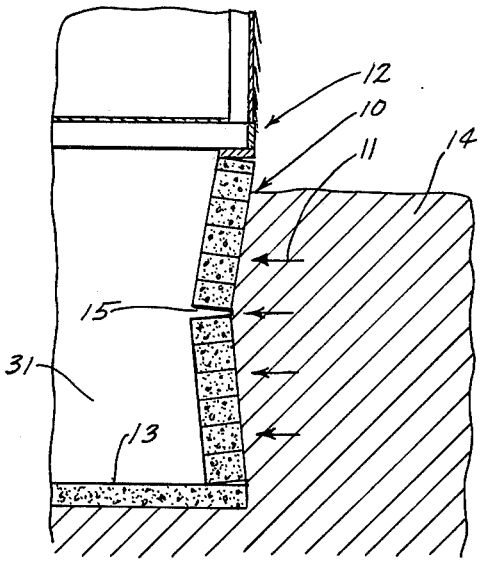
FIG. 1 is a cross-sectional view of a basement wall which has been pushed in by hydrostatic pressure forces.

Referring now to the drawings wherein like reference numerals designate identical or corresponding parts throughout the several views, FIG. 1 shows a wall 10 which has been pushed inwardly because of hydrostatic forces against the exterior thereof as indicated by the force arrows 11. A building 12, such as a house, rests on top of the basement wall 10 and a concrete slab 13 supports the bottom of the wall 10. The numeral 14 designates the earth around the basement wall 10. Attention is directed to the crack 15 in the wall 10 which can allow water from within the ground 14 to seep into the basement and which crack 15 also can become large enough due to hydrostatic forces 11 to cause the entire wall 10 to collapse within the basement.

Figure 2:
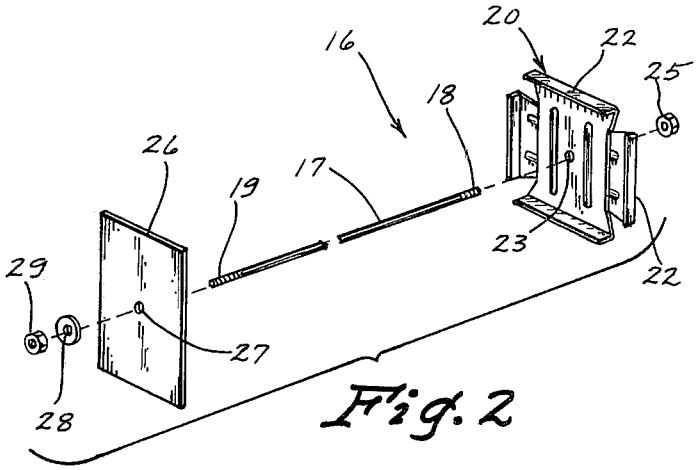
FIG. 2 is an exploded perspective view of an anchoring apparatus utilized in the present invention.

Referring now to FIG. 2, an anchoring structure 16 is shown. The anchoring structure includes a shaft 17 which is externally threaded on the ends 18 and 19. An anchoring plate 20, comprised of a pair of plates 21 and 22 welded together, has an opening 23 disposed centrally thereof. A pair of flanges 24 are welded to the plate 22 and are spaced so as to allow a nut 25 to be received therein and held from rotating so that the shaft 17 can be threaded into the nut 25, thereby securing the anchoring plate structure 20 to the shaft 17. A wall plate 26 is provided for the other end of the shaft 17 and includes a central opening 27 for allowing the end 19 of the shaft 17 to extend therethrough. A washer 28 and an internally threaded nut structure 29 is provided for holding the wall plate 26 from moving outwardly with respect to the shaft 17 once the nut 29 is threadably received on the threads 19 of the shaft 17.

Figure 3:
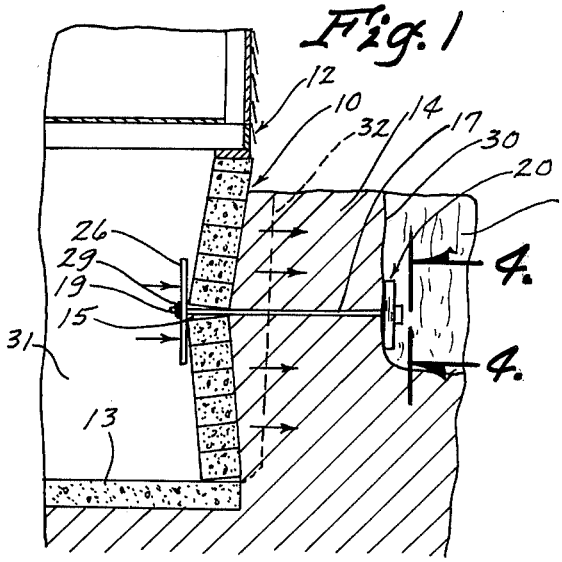
FIG. 3 is a view like FIG. 1, but showing an initial position of the anchoring apparatus of FIG. 2 as utilized in the present invention.

In order to straighten the wall 10 shown in FIG. 1, a hole 30 is first dug into the earth 14 as is clearly shown in FIG. 3. Then from inside of the basement 31, an opening must be formed through the crack 15 to allow the shaft 17 to be driven therethrough so that the end 18 extends into the hole 30. Normally this would require the use of a drill or chisel or the like in order to make an opening through the crack 15, but it is entirely possible that an opening large enough to receive the shaft 16 would already be present if the wall 10 had buckled to a large degree. Once the shaft 17 is driven inwardly to the position shown in FIG. 3, then the nut 25 is utilized by placing it between the flanges 24, aligning it with the threads 18 of the shaft 17 and then rotating the entire anchoring plate structure 20 so that the nut 25 is firmly secured onto the shaft 17. While this is a preferred embodiment of the invention, it is to be understood that other anchoring structures could be used instead of the specific anchoring structure 20 shown and likewise fastening structures other than the threaded one shown by threads 18 and nut 25 can be utilized to secure such anchoring structure to the shaft 17 and still be within the inventive concept of this invention.

The next step for straightening the wall 10 is then to slide the wall plate 26 onto the shaft 17 such that the opening 27 surrounds the threads 19 of the shaft 17. Then the washer 28 is placed over the end 19 of the shaft 17 and the nut 29 is threaded onto the threads 19 resulting in the structure as substantially shown in FIG. 3.

Figure 4:
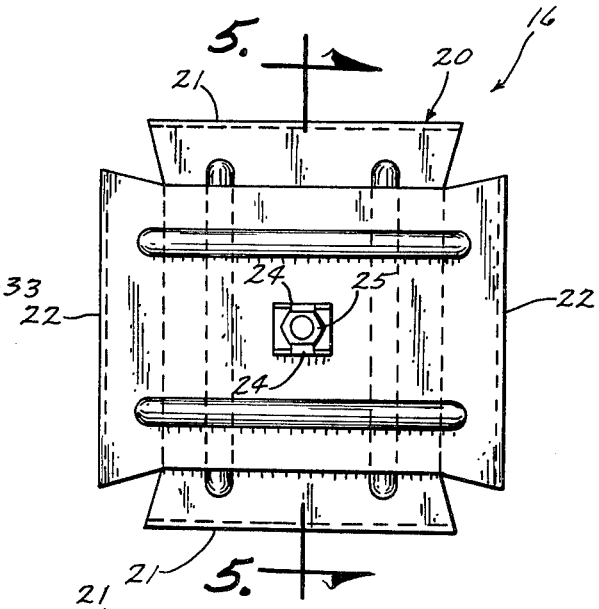
FIG. 4 is a view of one end of the anchoring plate shown in FIG. 2.
Figure 6:
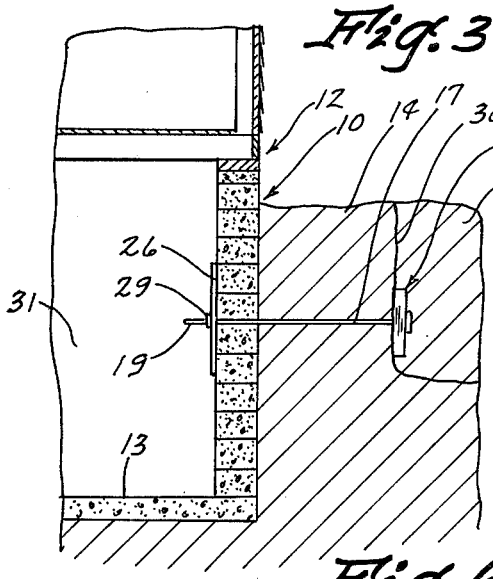
FIG. 6 is a cross-sectional view like FIGS. 1 and 3, but showing the relative positions of the wall and anchoring device after the straightening method of this invention has been accomplished.
Figure 5:
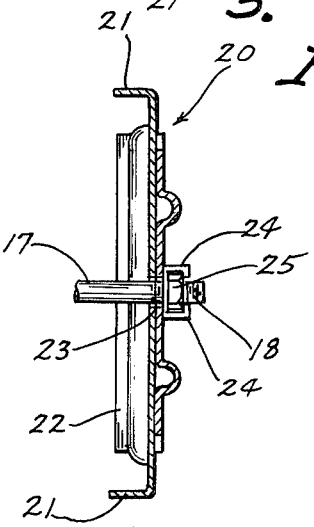
FIG. 5 is a cross-sectional view of the anchor plate of FIG. 4 taken along line 5—5 of FIG. 4.

Once the structure shown in FIGS. 2, 4 and 5 have been positioned substantially as shown in FIG. 3, then a large wrench (not shown) or the like is utilized to thread the nut 29 further onto the threads 19 of the shaft 17 so as to force the wall plate 26 towards the wall 10 and thereby force the wall 10 back to the straight position as shown in FIG. 6. At such time then the hole 30 can be refilled and the job is complete.

If, for any reason, the wall cannot be initially moved to a completely straight position by tightening the nut 25, the wall will be securely anchored and the owner of such structure 12 need not concern himself with whether or not the wall will fall in. Furthermore, as the ground 14 dries, it will shrink somewhat and provide a small space between the exterior of the wall 10 and the earth 14. When this occurs, the owner of the structure 12 can merely tighten the nut 29 to thereby further straighten the wall. This tightening procedure can occur whenever the ground continues to dry out.

A further optional step of this invention can be to excavate a small portion of earth, for example between the dashed lines 32 and the exterior of the wall 10, to provide a space into which the wall 10 can move with little or no resistance.

Accordingly, it is very clear that the disclosed invention does indeed accomplish the objects set forth above. Obviously, many modifications and variations of the present invention are possible in light of the above teachings. For example, the order in which the steps disclosed above are done can be varied considerably within certain limitations. It is therefore to be understood that, within the scope of the appended claims, the invention may be practiced otherwise than as specifically described.

We claim:

1. A method for anchoring and straightening a wall which extends below the ground comprising the steps of:

forming a hole in the ground at a distance from said wall;

forming an opening in said wall from one side of the wall at a level below the ground, said opening being substantially aligned with the hole in the ground;

forcing an elongated member through the opening in the wall and through the ground to a position in which one end of said member extends into said hole in the ground and the other end extends on said one side of the wall;

securing an anchoring means to said one end of the member;

attaching a wall plate to the other end of the elongated member; and forcing the wall plate towards the wall along said shaft whereby the wall plate is forced against said wall and the wall is thereby moved towards being straightened.

2. The method of claim 1 wherein said other end of the shaft is threaded and threaded nut means is utilized to attach the wall plate to said shaft whereby the step of forcing the wall plate towards the wall includes threadably tightening the nut means on said shaft.

3. The method of claim 1 wherein said opening is formed at a place in the wall which has cracked.

4. The method of claim 1 further comprising the step of filling in the hole formed in the ground.

5. The method of claim 1 including a step of removing dirt from a point in close proximity to said wall between the wall and said hole for providing a space into which said wall can easily move when being straightened.

* * * * *